United States Patent [19]

Berg

[11] Patent Number: 4,550,942

[45] Date of Patent: Nov. 5, 1985

[54] ELEVATOR/SPIDER WITH COUNTERBALANCE

[75] Inventor: Gunnar H. Berg, Austin, Tex.

[73] Assignee: Hughes Tool Company, Houston, Tex.

[21] Appl. No.: 588,188

[22] Filed: Mar. 12, 1984

[51] Int. Cl.[4] ..... E21B 19/10

[52] U.S. Cl. ..... 294/102.2

[58] Field of Search ..... 294/102 A, 90, 86.12, 294/86.1, 102 R, 87 R; 166/75 AV, 77.5, 85, 313

[56] References Cited

U.S. PATENT DOCUMENTS 3,149,391 9/1964 Boster ..... 24/263

FOREIGN PATENT DOCUMENTS 597811 3/1978 U.S.S.R. ..... 284/102 A

*Primary Examiner*—James B. Marbert

*Attorney, Agent, or Firm*—Robert A. Felsman; H. Dennis Kelly

[57] ABSTRACT

An elevator/spider having a series of slips in a tapered bowl and a yoke for pivotally setting slips, a torsion spring is mounted on the body of the elevator/spider. A wire rope connects the torsional spring to the yoke, so that the weight of the slips is counterbalanced by the force of the torsional spring.

3 Claims, 5 Drawing Figures

ELEVATOR/SPIDER WITH COUNTERBALANCE

BACKGROUND OF THE INVENTION

1. Field of the Invention

This invention relates in general to well casing handling equipment, and in particular to well casing elevator and spiders.

2. Description of the Prior Art

In a typical derrick arrangement, a traveling block is suspended from the derrick crown block by a series of cables, which are driven by the derrick drawworks to raise and lower the traveling block along the vertical axis of the derrick. The traveling block supports a derrick hook, a pair of links, and an elevator. When handling casing, sliptype elevators are used. Such elevators have a tapered interior bowl and a set of gripping slips, which are moved pivotally up and down within the bowl to grip the exterior surface of the casing.

A casing spider rests on the derrick floor and supports the casing string in the well bore with a set of slips, which are set to grip the casing exterior. A new joint of casing is raised into position over the well bore by the casing elevator, and the lower end of the casing joint is connected to the upper end of the casing string in the well bore. The elevator is then used to lift the casing string, releasing the slips of the lower spider, and then the casing string is lowered into the well bore. The slips of the spider are then set to support the casing string in the well bore, and the elevator is disengaged and stripped upward and off of the casing to allow another casing joint to be moved into position. This cycle is repeated until all of the casing has been run into the well bore.

Elevator/spiders are powerful, double-duty tools designed to handle long, heavy casing strings. These tools are convertible and can be used either as casing spiders or as elevators. Often, when handling casing strings, elevator/spiders will be used in tandem, utilizing one tool as a casing spider and the other tool as an elevator.

Elevator/spiders generally have slips which are pivotally operable between an upper, retracted position and a lower, gripping position. The slips are moved between the upper and lower positions by a yoke, which is connected to the slips by suitable linkages. The yoke pivots about a pivot axis in the approximate center of the yoke, when fluid pressure is applied to the fluid cylinders connected to the other end of the yoke.

The slips may also be raised and lowered manually by an operator using a handle inserted into a socket on the yoke. Whether the slips are raised and lowered manually or hydraulically, the weight of the slips should be counterbalanced. Counterbalancing the slips makes it easier for the operator to raise the slips, and lessens the chances of damage to the elevator/spider, the slips, and the casing, when the slips are lowered. U.S. Pat. No. 3,149,391 (Boster), issued on Sept. 22, 1964, shows one method of counterbalancing the weight of the slips. A compression spring is attached to the yoke to urge the yoke in a direction which applies an upward force on the slips. Another type of counterbalance is a torsional spring mounted on the pivot point of the yoke. All of the prior art counterbalances have been rather large, and somewhat difficult to install and to remove from the elevator/spider, partly because the spring must be preloaded prior to installment.

SUMMARY OF THE INVENTION

This invention provides a safe, easy to install counterbalance for the slips of an elevator/spider. The counterbalance mechanism is a torsional spring, mounted on the body of the elevator/spider below the yoke. A wire rope extends from a connection on the yoke down to a sheave which is attached to the free end of the torsional spring.

In operation, when the slips are in their upper, retracted position, there is no force on the torsional spring. As the slips are lowered, either manually or hydraulically, the spring end of the yoke rises and pulls the wire rope upward. The wire rope turns the sheave, winding the torsional spring. The force of the torsional spring counterbalances the weight of the falling slips. The counterbalance of the torsional spring also makes it easier to raise the slips. As the slips approach their upper, retracted position, the moment arm between the pivot point and the slips becomes shorter, and the moment arm between the pivot point and the spring end of the yoke becomes longer. Thus, as the slips are raised, and the force of the torsional spring lessens, the effect of the torsional spring on the slips is increased by the changing moment arms. The overall result is that the effect of the torsional spring on the weight of the slips remains generally constant.

The above, as well as additional objects, features, and advantages of the invention, will become apparent in the following detailed description.

DETAILED DESCRIPTION OF THE PREFERRED EMBODIMENT

Figure 1:
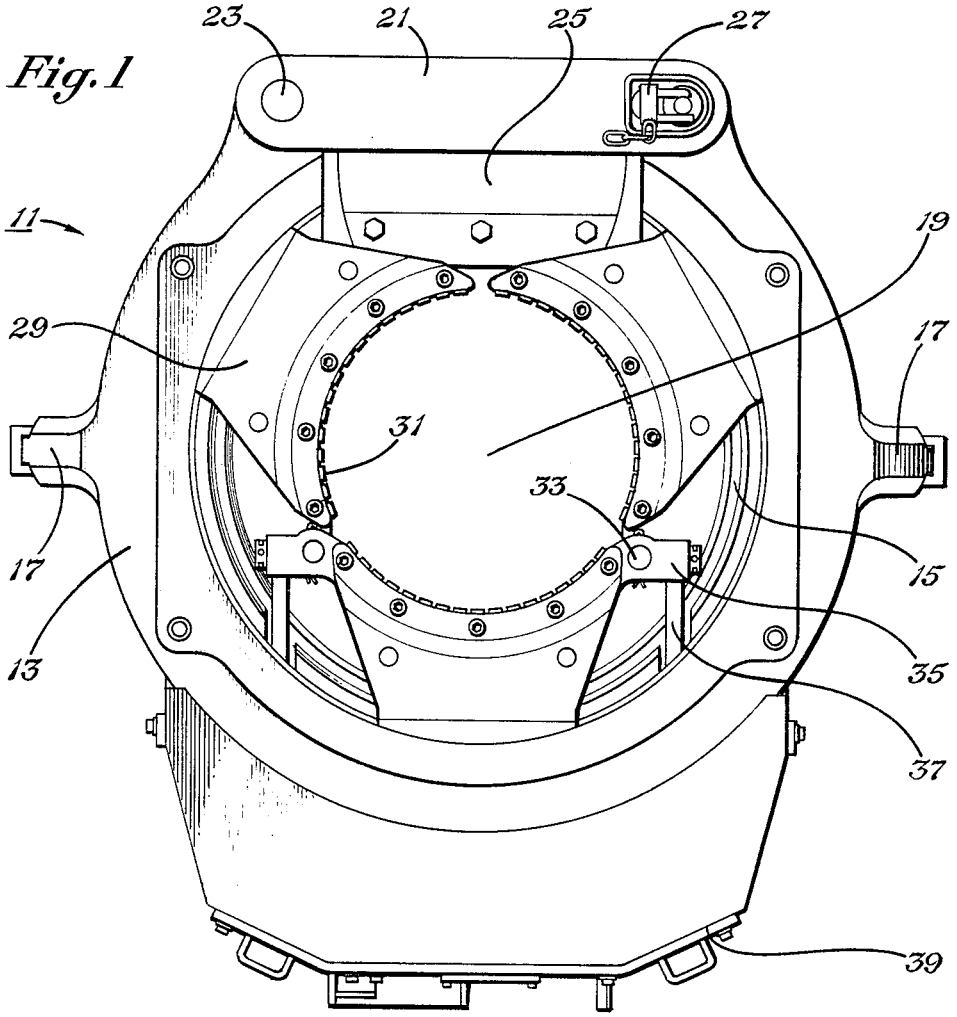
FIG. 1 a top view of the improved elevator/spider.

FIG. 1 illustrates an elevator/spider, designated generally as 11, having a cylindrical body 13 with a tapered interior bowl 15. A pair of ears 17 are provided on the sides of the body 13, so that the elevator 11 may be suspended from a derrick hook with links. A central bore 19 through the body 13 receives a section of pipe, casing, or tubing. A side gate 21, which pivots about a point 23 on one side of a gate opening 25, provides radial access to the bore 19. The side gate 21 is secured to the body 13 by a latch mechanism 27 on the opposite side of opening 25. A set of three slips 29 are seated in the tapered bowl 15. Each slip 29 has gripping teeth 31, on the interior face, which are equally spaced about the vertical axis passing through the center of bore 19.

Figure 2:
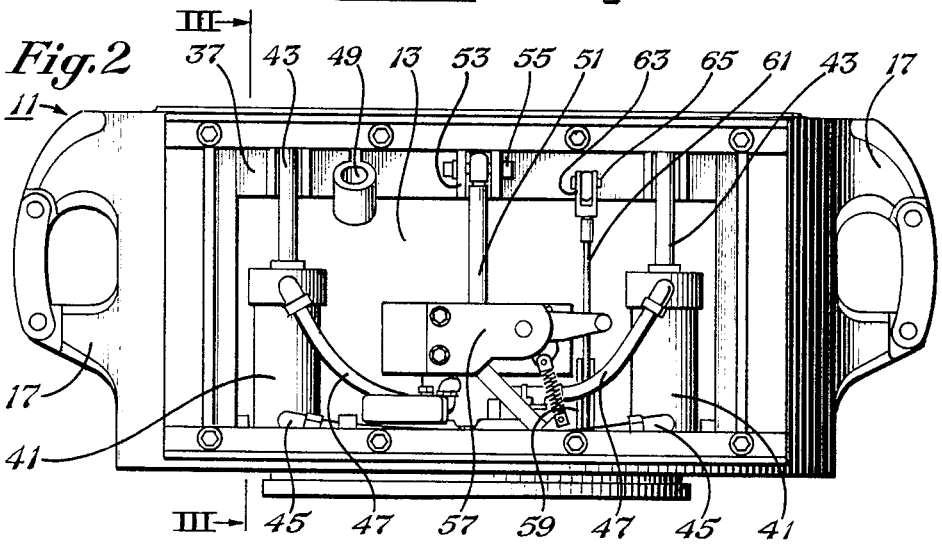
FIG. 2 is a back view of the elevator/spider, with the cover removed.

Each of the slips 29 is connected for pivotal movement by pins 33 and linkages 35 to a yoke 37. FIG. 2 shows the elevator/spider 11 with the rear cover 39 removed. A pair of fluid cylinders 41 are mounted on the body 13 and have output shafts 43 connected to the yoke 37. When fluid pressure is applied through fluid conduits 45 to the lower ends of the fluid cylinders 41, the output shafts 43 extend upward, raising the yoke 37

When fluid pressure is applied through fluid conduits 47 to the upper ends of the fluid cylinders 41, the output shafts 43 retract downward, lowering the yoke 37. A socket 49 is provided on the yoke 37, so that a lever can be inserted and the yoke 37 can be raised and lowered manually.

A lock rod 51 is attached to the yoke 37 by means of a clevis 53 and a pin 55. The lock rod 51 extends downward into a locking mechanism 57, which is attached to the body 13. A counterbalance mechanism 59 is mounted to the body 13 below the locking mechanism 57. A wire rope 61 is the connector means for connecting the counterbalance mechanism 59 to the yoke 37. The wire rope 61 is connected to the spring end of the yoke 37 with a clevis 63 and a pin 65.

Figure 3:
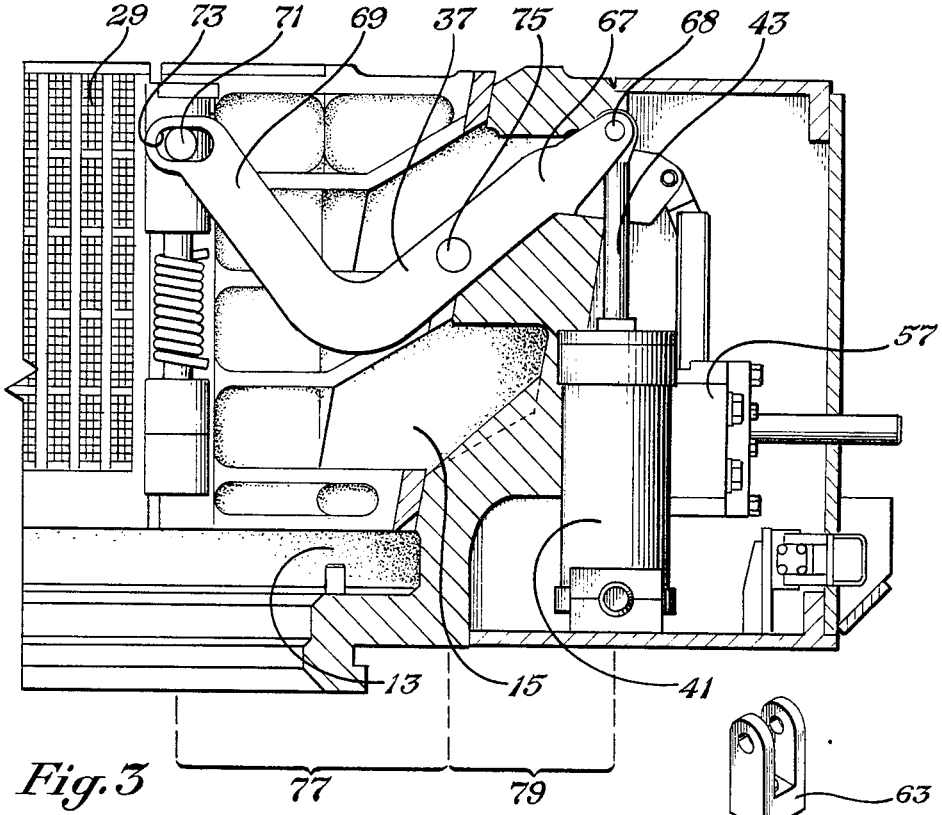
FIG. 3 is a sectional view of the elevator/spider, taken along lines 3—3 of FIG. 2, with the slips in the lower, gripping position.
Figure 4:
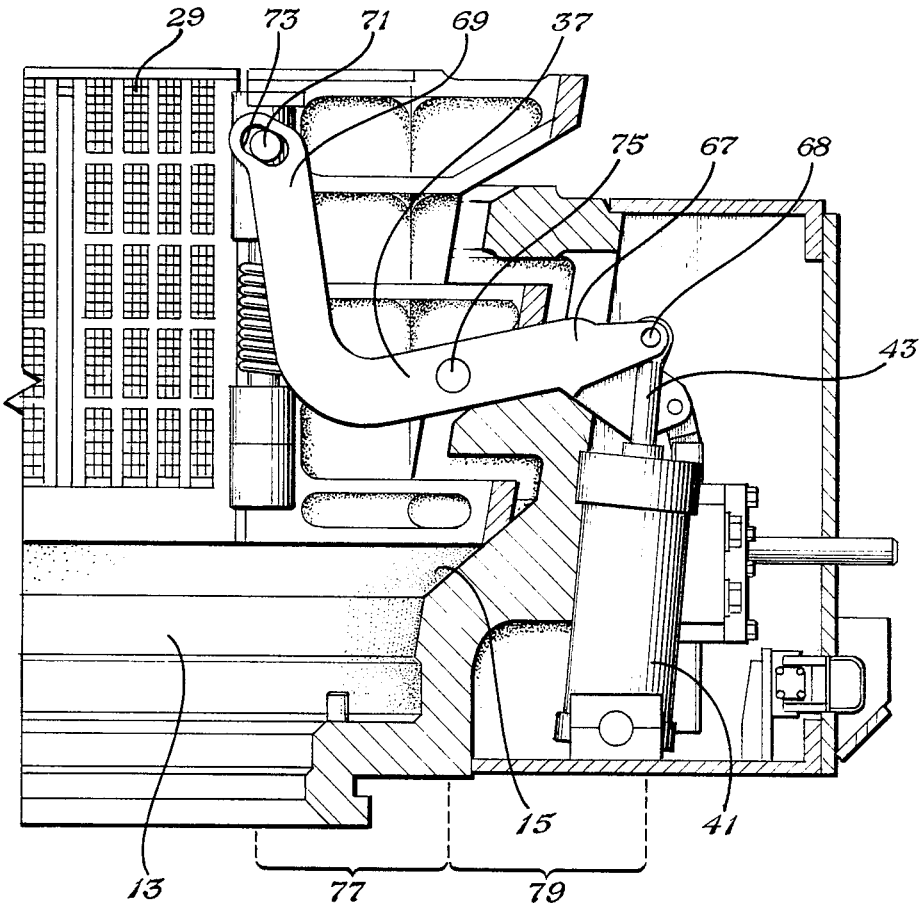
FIG. 4 is a sectional view of the elevator/spider, taken along lines 3—3 of FIG. 2, with the slips in the upper, retracted position.

FIGS. 3 & 4 are sectional views of the elevator/spider 11. The output shafts 43 are connected to the spring end 67 of the yoke 37 by a pin 68. The slips 29 have a pin 71, which fits within an oval slot 73 in the slip end 69 of the yoke 37. As the output shaft 43 moves upward, the yoke 37 rotates about a pivot point 75 and lowers the slip 29. When the output shaft 43 moves downward, the yoke 37 pivots in the opposite direction, and raises the slips 29. When the slips 29 are raised, the slips 29 move upward and outward in the bowl 15. Thus, as the slips 29 are moved upward, the slips 29 are also retracted. When the slips 29 are moved downward, the slips 29 are also moved inward to a gripping position. The moment arm, indicated by numeral 77, between the pivot point 75 and the slip 29 becomes shorter as the slips are raised. Conversely, the moment arm, indicated by numeral 79, between the pivot point 75 and the pin 68 becomes longer as the slips are raised.

Figure 5:
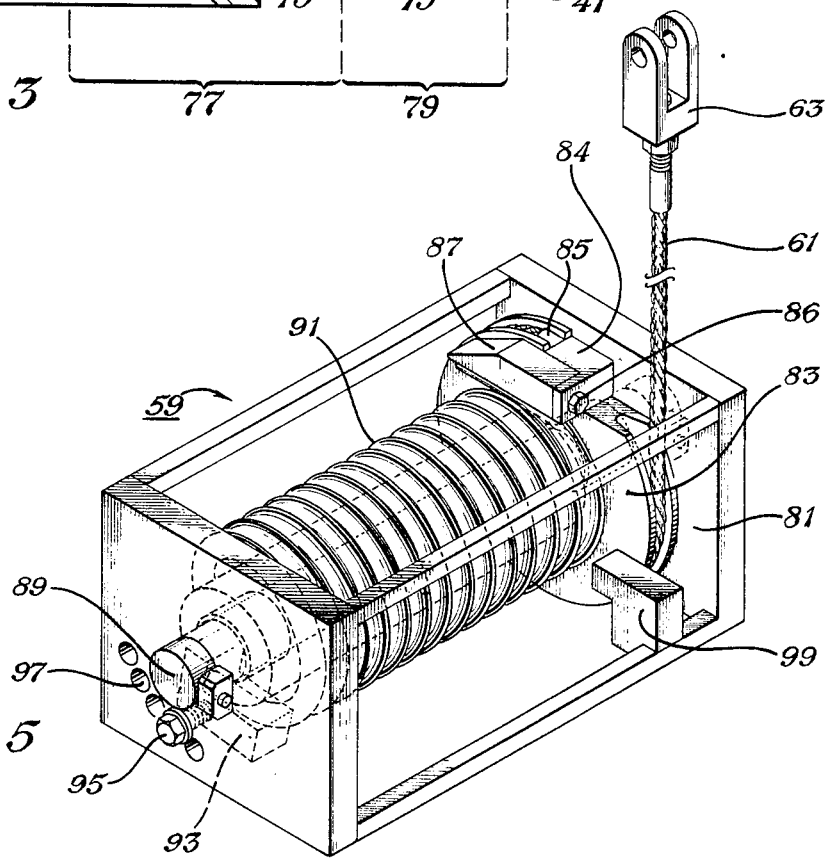
FIG. 5 is a perspective view of the counterbalance mechanism.

The counterbalance mechanism 59 is illustrated in detail in FIG. 5. The counterbalance mechanism 59 is housed in a metal frame 81. The wire rope 61 enters the mechanism 59 from above, and extends 270 degrees around a sheave 83. The dead end of the wire rope 61 is connected to the sheave 83 with a swage button 85. This swage button 85 is placed into a sheave swage pocket to retain the dead end of the wire rope 61. The swage button 85 is further retained by a swage button cap 84, to keep the wire rope 61 in the sheave groove 83. The swage button cap 84 is held in place by a capscrew and lockwasher 86. A sheave spring stop 87 is connected to the sheave 83 near the point where the wire rope 61 is attached. The sheave 83 rotates around a shaft 89, which is mounted in the frame 81.

A torsional spring 91 is mounted on the frame 81 with a dead end block 93. The dead end block 93 is attached to the frame 81 with a cap screw 95. The frame 81 has a plurality of holes 97, so that tension on the torsional spring 91 may be adjusted. A barrier block 99 is attached to the bottom of the frame 81 to limit the travel of the sheave 83.

In operation, there is no force on the torsional spring 91 when the slips 29 are in the upper, retracted position, and the slip end 69 of the yoke 37 is in the lower position. As the slips 29 are lowered, either hydraulically or manually, the spring end 67 of the yoke 37 is raised. The wire rope 61 is pulled upward, and the sheave 83 is rotated. As the sheave 83 rotates, the torsional spring 91 is wound, and counterbalances the weight of the slips 29. Normal travel of the sheave 83 is 149 degrees, but if for some reason the sheave 83 is further rotated, the barrier block 99 limits sheave 83 travel to a maximum of 180 degrees. The barrier block 99 thus prevents overloading of the torsional spring 91, and also prevents the wire rope 61 from being pulled completely out of the sheave 83.

When the slips 29 are in the lower, gripping position, the torsional spring 91 is wound and counterbalances the weight of the slips 29. Thus, the force of the torsional spring 91 helps to break out the slips 29 and to raise the slips 29. As the slips 29 approach the upper, retracted position, the torsional spring 91 begins to weaken. However, the moment arm 79 between the pivot point 75 and the spring end 67 of the yoke 37 becomes longer, and the moment arm 77 between the pivot point 75 and the slip end 69 of the yoke 37 becomes shorter. The effect of this change in moment arms 77, 79 is to increase the effect of the torsional spring 91 as the slips 29 are raised. As a result, the overall effect of the torsional spring 91 on the slips 29 remains generally constant.

The improved counterbalance mechanism 59 provides several advantages over the prior art. The modular construction of the counterbalance mechanism 59 makes it easy to install and to remove the mechanism 59 from the body 13 of the elevator/spider 11. Also, there is no need to preload the spring 91 prior to installation, because there is no force on the spring 91 when the slips are in the upper, retracted position. Thirdly, because of the force multipling effect of the moment arms 77, 79, a smaller spring 91 may be used to counterbalance the weight of the slips 29. The plurality of holes 97 in the easily accessible counterbalance mechanism 59 makes it easy to adjust the tension on the counterbalance spring 91.

While the invention has been shown in only one of its forms, it should be apparent to those skilled in the art that it is not so limited, but is susceptible to various changes and modifications without departing from the spirit thereof.

I claim:

1. An improved elevator/spider, comprising:

a body having a tapered bowl;

a series of slips, in the tapered bowl, reciprocally mounted to move between an upper, retracted position and a lower, gripping position;

a yoke, pivotally mounted to the body, and having a pivot point between a slip end and a spring end, wherein the slip end of the yoke is attached to the slips to raise and lower the slips;

a torsional spring, mounted on the body away from the pivot point of the yoke, to counterbalance the weight of the slips; and connector means for connecting the spring end of the yoke to the torsional spring.

2. An improved elevator/spider, comprising:

a body having a tapered bowl;

a series of slips, in the tapered bowl, reciprocally mounted to move between an upper position and a lower position;

a yoke, pivotally mounted on the body, and having a pivot point between a slip end and a spring end, wherein the slip end of the yoke is attached to the slips to raise and lower the slips;

a wire rope, having a dead end and a live end, wherein the live end is attached to the spring end of the yoke; and a torsional spring, mounted on the body below the yoke, and attached to the dead end of the wire rope.

3. An improved elevator/spider, comprising:

a body having a tapered bowl;

a series of slips, in the tapered bowl, reciprocally mounted to move between an upper position and a lower position;

a yoke, pivotally mounted on the body, and having a pivot point between a slip end and a spring end, wherein the slip end of the yoke is attached to the slips to raise and lower the slips, creating a moment arm between the pivot point and the slips;

a wire rope, having a dead end and a live end, wherein the live end is attached to the spring end of the yoke, creating a moment arm between the pivot point and the wire rope; and a torsional spring, mounted on the body below the yoke, on an axis perpendicular to the longitudinal axis of the body, and attached to the dead end of the wire rope.

* * * * *